US007513804B2

(12) United States Patent
Ju

(10) Patent No.: US 7,513,804 B2
(45) Date of Patent: Apr. 7, 2009

(54) ELECTRICAL CONNECTOR

(75) Inventor: Ted Ju, Keelung (TW)

(73) Assignee: Lotes Co., Ltd., Anloku, Keelung (TW)

( * ) Notice: Subject to any disclaimer, the term of this patent is extended or adjusted under 35 U.S.C. 154(b) by 0 days.

(21) Appl. No.: 12/044,509

(22) Filed: Mar. 7, 2008

(65) Prior Publication Data

US 2008/0227328 A1 Sep. 18, 2008

(30) Foreign Application Priority Data

Mar. 15, 2007 (CN) ..... 2007 2 0141690 U

(51) Int. Cl.
*H01R 13/40* (2006.01)

(52) U.S. Cl. ..... 439/733.1; 439/936

(58) Field of Classification Search ..... 439/733.1, 439/595, 328, 936
See application file for complete search history.

(56) References Cited

U.S. PATENT DOCUMENTS 5,348,488 A * 9/1994 Green et al. ..... 439/140
6,551,121 B1 4/2003 Li et al.
6,811,449 B2 * 11/2004 Yamashita ..... 439/733.1

FOREIGN PATENT DOCUMENTS

CN 2781588 Y 5/2006

* cited by examiner

*Primary Examiner*—Khiem Nguyen
(74) *Attorney, Agent, or Firm*—Morris, Manning & Martin LLP; Tim Tingkang Xia

(57) ABSTRACT

An electrical connector includes an insulating base and at least one row of conducting terminals. Each row of conducting terminals includes a body portion, a connecting arm located at two ends of the body portion, and a connecting portion. The insulating base includes a holding portion. The connecting arm is held on the holding portion. Because the connecting arm of the conducting terminal of the electrical connector is held on the holding portion of the insulating base, the coplanarity of the connecting portion of the conducting terminal can be assumed by keep the roughness of the holding portion of the insulating base. It prevents that the whole conducting arm of the conducting terminal is pasted on the insulating base to decrease the coplanarity of the connecting portion.

15 Claims, 14 Drawing Sheets

ELECTRICAL CONNECTOR

CROSS-REFERENCE TO RELATED APPLICATIONS

This non-provisional application claims priority under 35 U.S.C. § 119(a) on Patent Application No(s). 200720141690.8 filed in China on Mar. 15, 2007, the entire contents of which are hereby incorporated by reference.

BACKGROUND OF THE INVENTION

1. Field of the Invention

The invention relates to an electrical connector.

2. Description of the Prior Art

With the continuous development of the electrical technologies, the electronic products are developing in the direction of lightness and thinness. Not only the volume of the storage media for the electronic product, but also the volume of the electrical connector connecting to electronic products has become smaller.

As disclosed in U.S. Pat. No. 6,551,121, a general thin electrical connector includes an insulating base and a terminal set in the insulating base. The terminal includes a body portion and a contacting arm extending from the body portion. The contacting arm is connected to a connecting portion on the surface of an electrical card. A method of stamping and cutting a metal board is necessary to produce the terminal due to the structure of the terminal. However, compared to the terminal producing method of bending the terminal and setting it in the insulating base, the method wastes a lot of materials and increases the cost.

Because of the structure of the thin electrical connector, it is very hard to fabricate the bending terminal in the insulating base and make sure that the terminal is steadily fixed in the terminal accepting tank.

Another type of the electrical connector is the computer peripheral interface such as USB, S-ATA. The terminal of the electrical connector is generally fixed on the insulating base using the method described in China patent numbered 002011691.5 or 200520007807.4. In the two patents, one end of the terminal of the electrical connector is wedged on the insulating base; the other end is fixed in a terminal positioning base or a pressing block which is separated from the insulating base. The terminal can be firmly fixed on the insulating base to keep it normally work. However, a positioning base or a pressing block for fixing the terminal is needed in this design. Thus, the structure is complicated and the cost is higher.

Therefore, designing a new type of electrical connector to overcome the above drawbacks is needed.

SUMMARY OF THE INVENTION

The goal of the invention is to provide a lower-cost electrical connector which a terminal can be easily assembled thereon and the terminal can be steadily fixed in an insulating base.

In order to reach the above goal, the electrical connector based on the invention includes an insulating base and a terminal. The insulating base has a terminal accepting tank for accepting the terminal. A fixing structure for fixing the terminal via a melt glue method is located at the terminal accepting tank of the insulating base.

Another embodiment of the invention is an electrical connector including an insulating base and a terminal. The insulating base has a plurality of fences. A terminal accepting tank capable of accepting the terminal is formed between the adjacent fences. A fixing structure is located at an extending end of the fences.

The fixing structure for fixing the terminal via a melt glue method is located at the terminal accepting tank of the insulating base of the electrical connector based on the invention. Or, the fixing structure for fixing the terminal is located at an extending end of the fences. The terminal can be effectively fixed in the insulating base, and the problems occurred in the prior arts can be prevented.

BRIEF DESCRIPTION OF THE APPENDED DRAWINGS

DETAILED DESCRIPTION OF THE INVENTION

The electrical connector based on the invention is further explained by the following embodiments together with the appended drawings.

Figure 15:
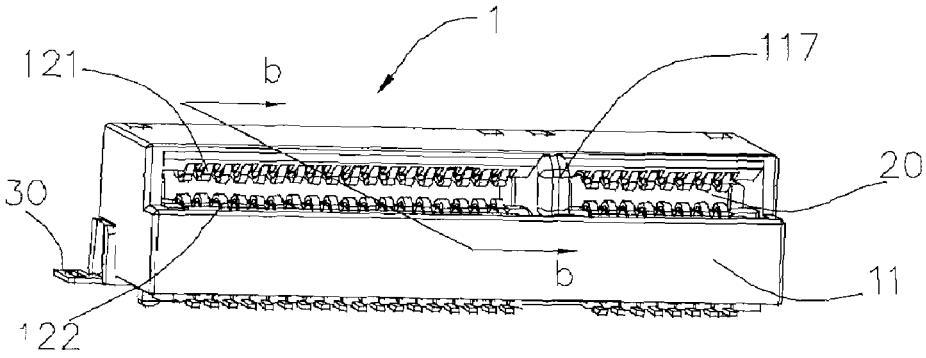
FIG. 15 is a three-dimensional diagram after the insulating base, the housing, and the terminal are fabricated.
Figure 16:
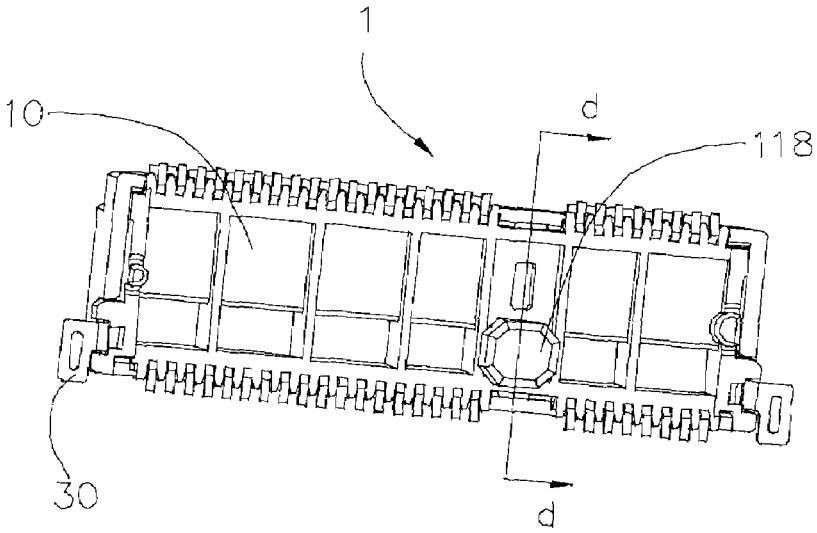
FIG. 16 is a three-dimensional diagram of FIG. 15 in another direction.

Please refers to FIG. 15~16, according to the invention, an electrical connector 1 includes an insulating base 10, a housing 11 corresponding to the insulating base 10, and a terminal between the insulating base 10 and the housing 11.

Figure 1:
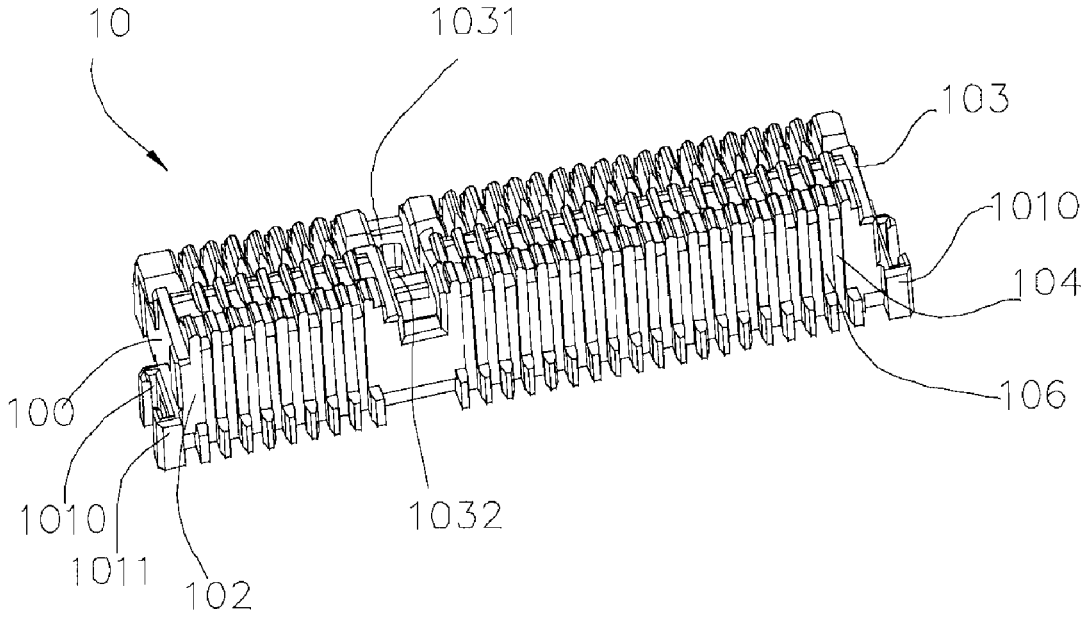
FIG. 1 is a three-dimensional diagram of the insulating base based on the invention.
Figure 2:
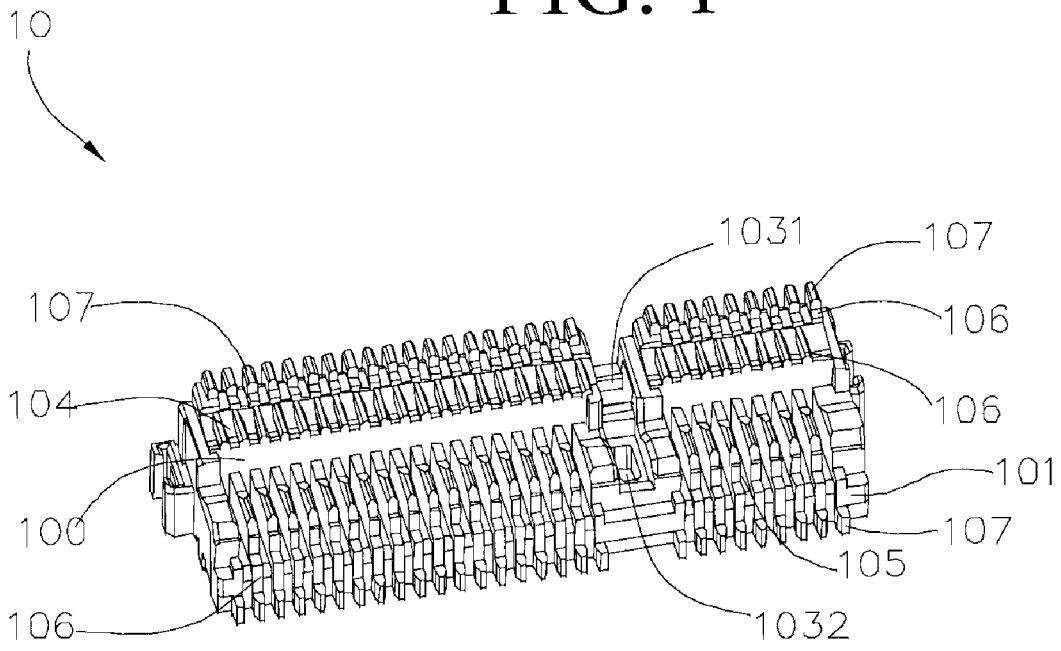
FIG. 2 is a three-dimensional diagram of the insulating base shown in FIG. 1 in another direction.
Figure 3:
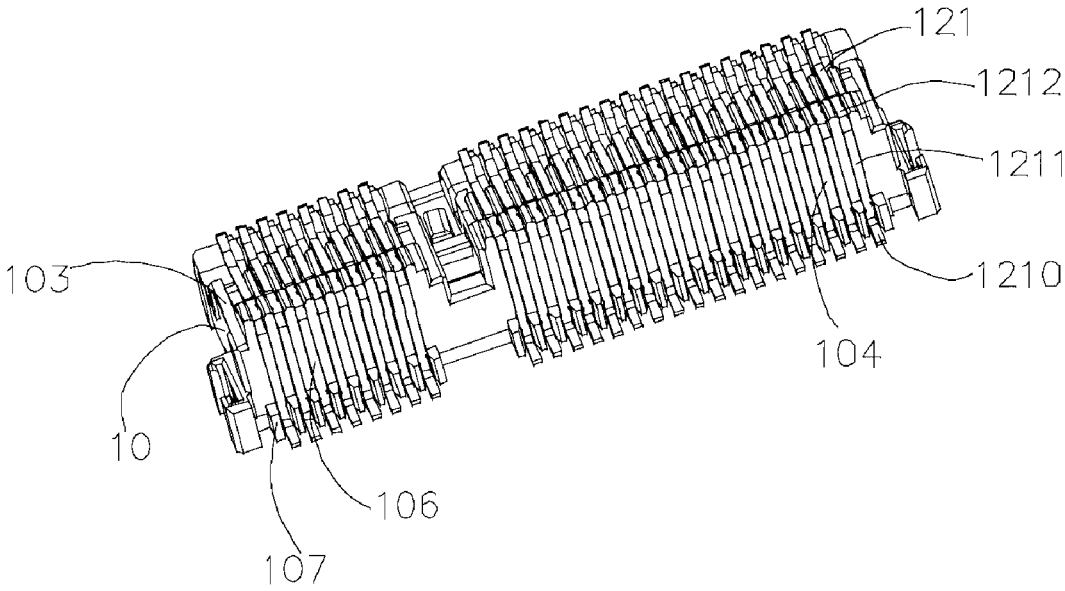
FIG. 3 is a diagram of the insulating base shown in FIG. 1 after the terminal is fabricated.
Figure 4:
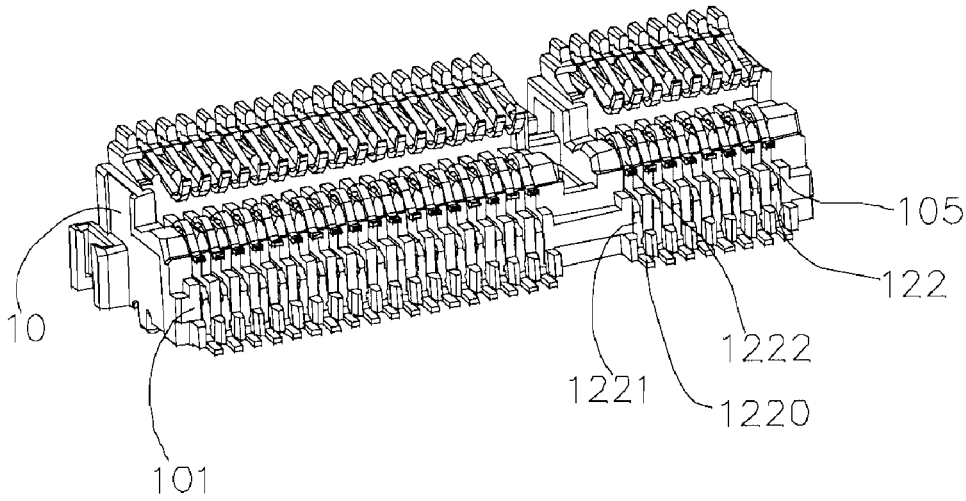
FIG. 4 is a three-dimensional diagram of the insulating base shown in FIG. 3 in another direction.
Figure 5:
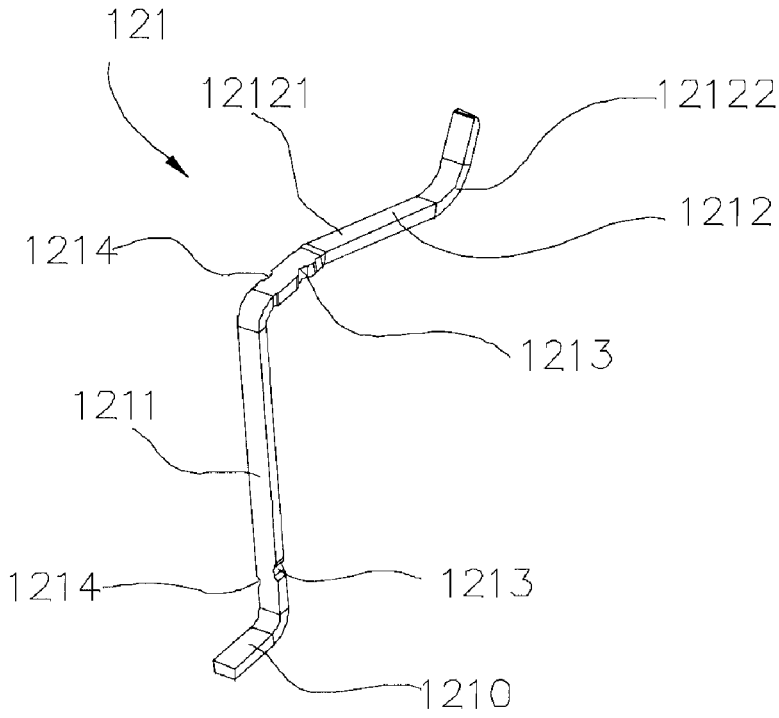
FIG. 5 is a three-dimensional diagram of the first terminal.
Figure 6:
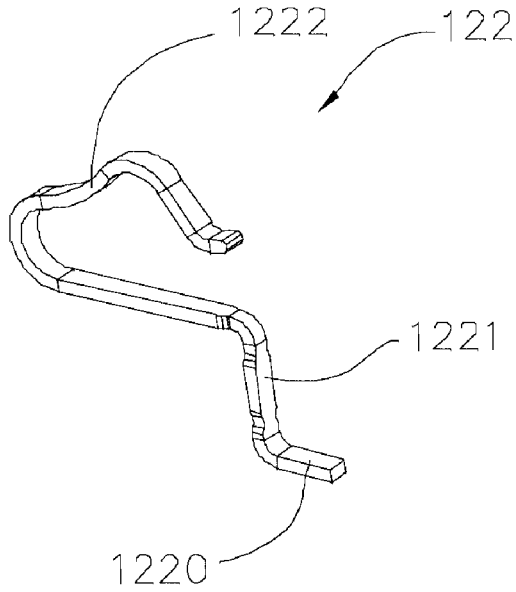
FIG. 6 is a three-dimensional diagram of the second terminal.

As shown in FIG. 1~2, the insulating base 10 includes a base portion 100. A front end surface 101, a back end surface 102, and a top surface 103 are respectively located at the front, the back and the top of the base portion 100. Terminal accepting tanks are located at the front side, the back side, and the upper side of the base portion 100. The detail is that a penetrated first terminal accepting tank 104 is located at the back end surface 102 and the top surface 103, and a second terminal accepting tank 105 is located at the front end surface 101. A fence 106 is deposed between the adjacent first terminal accepting tanks 104. The fences on the back end surface 102 and the top surface 103 has an extruding portion 107 respectively. A fence 106 is also deposed between the adjacent second terminal accepting tanks 105. The fence on the front end surface 103 also has an extruding portion 107. The extruding portion 107 can form a fixing structure for fixing the terminal via the melt glue method. The characteristic will be described in detail later.

An accepting tank 1031 is located at the position which a distance away from the center of the top surface 103 of the insulating base. A trough 1032 passing through the insulating base 10 is in the accepting tank 1031. Fixing portions 1010 are respectively extruded at the two side surfaces of the insulating base 10. The tank 1011 which penetrates the bottom surface is located at each of the fixing portions. The tank 1011 is used for matching the welded fixing device 30 (as shown in FIGS. 15~16). The fixing device 30 is welded on the circuit board (not shown in the figure) to fix the insulating base on the circuit board.

Please refers to FIG. 3~FIG. 6, the terminal includes a first terminal 121 and a second terminal 122. Both the first terminal and the second terminal include a connecting portion, a body portion extending from the connecting portion, and a contacting portion extending from the body portion. The first terminal 121 includes a first connecting portion 1210, a first body portion 1211 extending from the first connecting portion 1210, and a first contacting portion 1212 extending from the first body portion 1211.

The first contacting portion 1212 includes a connecting arm 12121 connecting to the first body portion 1211 and a connecting portion 12122 located at the end of the connecting arm 12121 capable of connecting to the external electrical devices (e.g., electrical card, not shown in the figure). The first terminal 121 is in the first terminal accepting tank 104. The first body portion 1211 is in the terminal accepting tank located at the back end surface 102.

The first contacting portion 1212 is in the terminal accepting tank located at the top surface 103. The second terminal 122 includes a second connecting portion 1220, a second body portion 1221 extending from the second connecting portion 1220, and a second contacting portion 1222 extending from the second body portion 1221. The second terminal 122 is in the second terminal accepting tank 105. The second body portion 1221 is in the second terminal accepting tank 105 located at the front end surface 101.

A first hollow portion 1213 and a second hollow portion 1214 are located at the first body portion 1210 of the first terminal 121 and the connecting arm 12121 of the first contacting portion 1212 at the same time. And, the first hollow portion 1213 and the second hollow portion 1214 are interlaced and not oppositely set to prevent that the area of the terminal the hollow portion is too narrow to be easily snapped. After the first terminal and the second terminal are set in the insulating base, both an upper row and a lower row of the terminals are formed at two sides of the insulating base.

Figure 7:
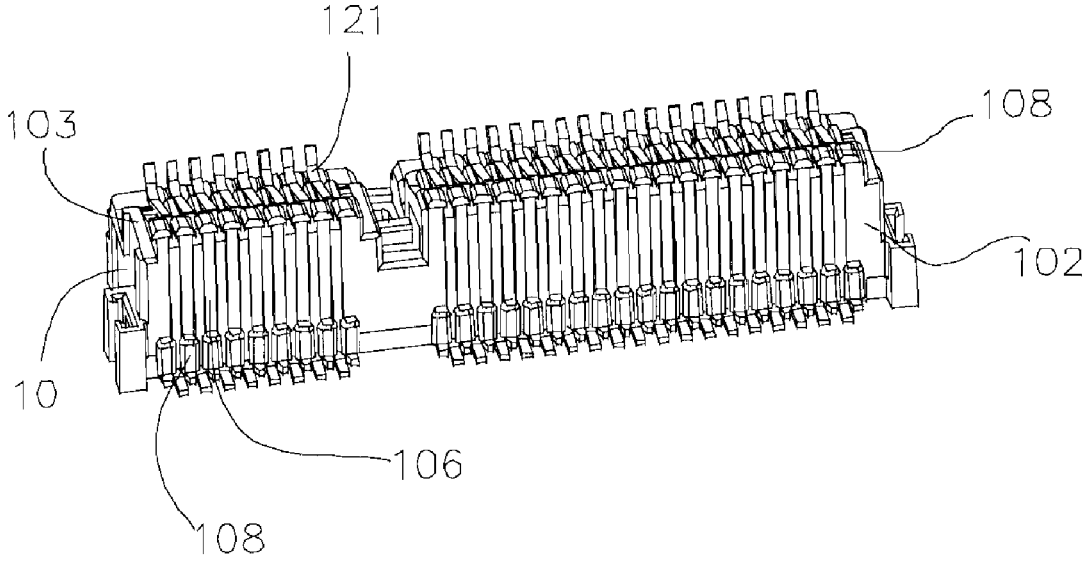
FIG. 7 is a three-dimensional diagram of the insulating base shown in FIG. 3 after the melt glue fixing method is performed.
Figure 8:
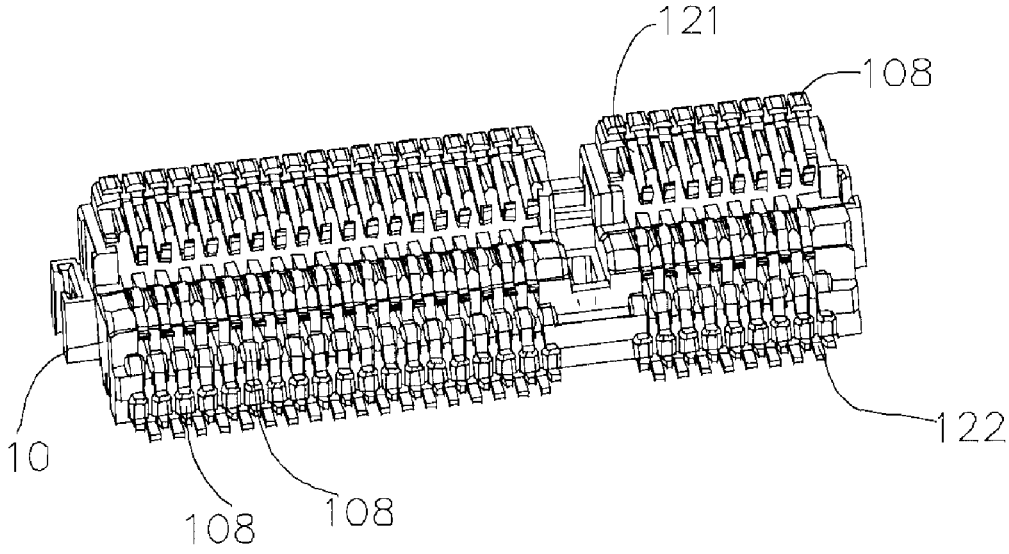
FIG. 8 is a three-dimensional diagram of the insulating base shown in FIG. 7 in another direction.
Figure 9:
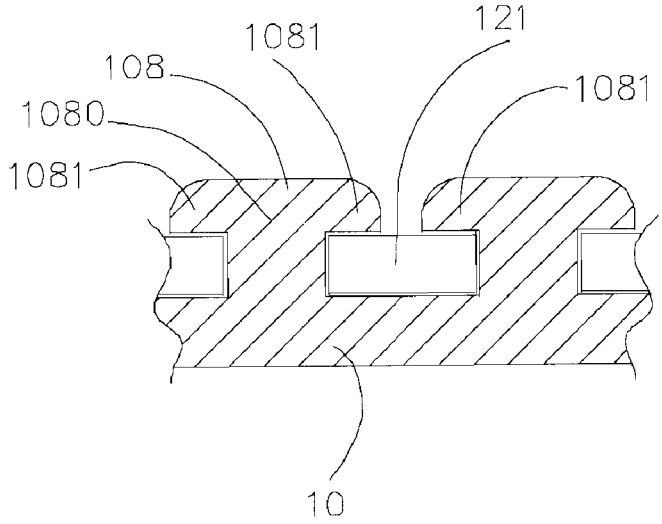
FIG. 9 is a partial cross-section diagram of FIG. 8.
Figure 10:
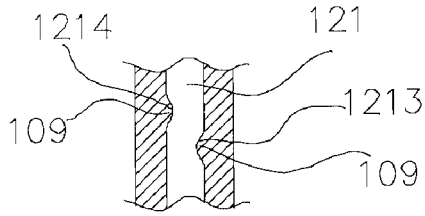
FIG. 10 is another partial cross-section diagram of FIG. 8.

Please refer to FIG. 7~FIG. 10 at the same time, when the extruding portion 107 is described above, it has been explained that the extruding portion can form the fixing structure for fixing the terminal via the melt glue method. As shown in FIGS. 7~8, the fixing structure 108 for fixing the terminal is formed by melting the extruding portion 107 via the supersonic effect, high temperature, or other methods. The end of the fence 106 extends toward the terminal to form the fixing structure 108, the cross-section of the fixing structure forms a mushroom shape.

The fixing structure includes a prominent portion 1080 located at the sides of the terminal, and a fixing block 1081 transversely extending toward the terminal from the top of the prominent portion 1080 above the terminal. The end of the fixing block 1081 is not over the center of the terminal. The fixing blocks 1081 located at the two adjacent fixing structures 108 are both hooked at the same terminal, so the terminal can be firmly fixed. The fixing structures 108 of the top surface 103 and the back end surface 102 are respectively located at the area of the first body portion 1211 of the first terminal 121 near the first connecting portion 1210 and the area of the first contacting portion 1212 near the first body portion 1211.

The connecting arm and the first body portion located at the base portion are fixed by the fixing structure 108. The first terminal is fixed at the insulating base. The first hollow portion 1213 and the second hollow portion 1214 are located between the fixing structures 108, and wedging portions 109 corresponding to the first hollow portion 1213 and the second hollow portion 1214 are located at the fixing structure 108. The wedging portion 109 is formed from the partial melted material of the extruding portion 107 at the fence flowing into the first hollow portion 1213 and the second hollow portion 1214 after the melt glue is used.

If the hollow portion is not set, the fixing structure 108 formed by the melt glue can only control the freedom degree of the terminal at the surface vertical to the fixing structure 108 after the first terminal is fixed to the extruding portion 107 by the melt glue. But the terminal can still move in the parallel direction to the fixing structure 108. Namely, the first terminal can move in the direction of back and forth or up and down relative to the insulating base 10. The stability of the first terminal in the insulating base 10 is lowered. When the partial melted material flows into the first hollow portion 1213 and the second hollow portion 1214 after the melt glue is used, the prominent portion 1080 wedged with the first terminal is formed. The first terminal is fixed by the plastics in all directions to effectively increase the stability of the first terminal fixed in the insulating base 10 to prevent the terminal swaying.

The fixing structures 108 of the front end surface 101 are respectively located at the area of the second body portion 1221 of the second terminal 122 near the second connecting portion 1220 and the area of the second contacting portion 1222 near the second body portion 1221. Thus, the first terminal 121 and the second terminal 122 are more effectively fixed in the insulating base by the fixing structure 108. Of course, the cross-section of the mentioned fixing structure can be a rectangle, a triangle, a shape of fan, or other shapes which can increase the fixing effect.

Figure 11:
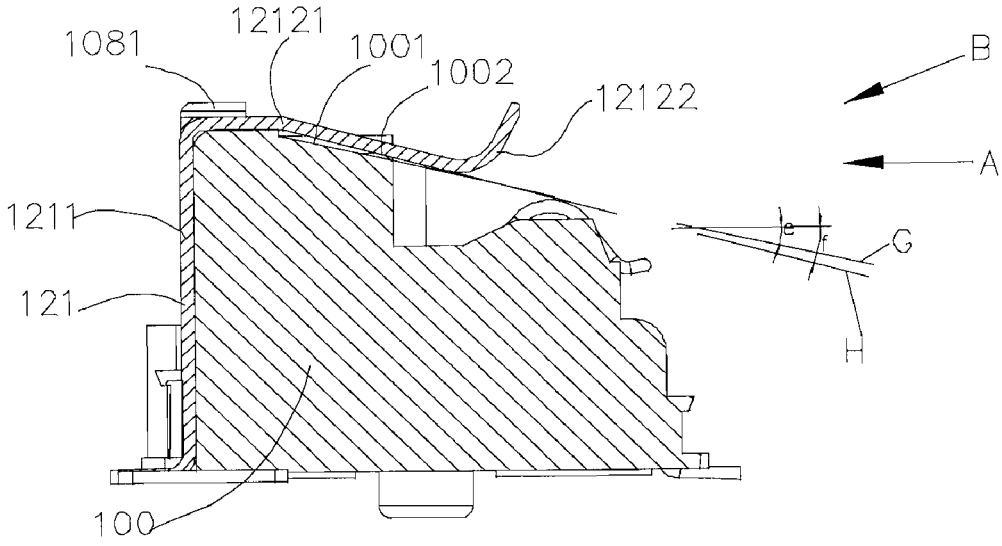
FIG. 11 is a cross-section diagram of FIG. 8.
Figure 12:
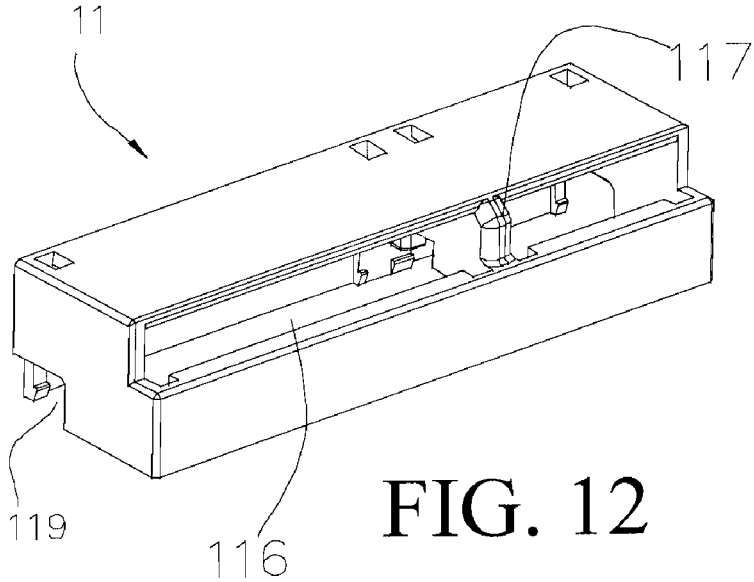
FIG. 12 is a three-dimensional diagram of the housing of the electrical connector based on the invention.
Figure 13:
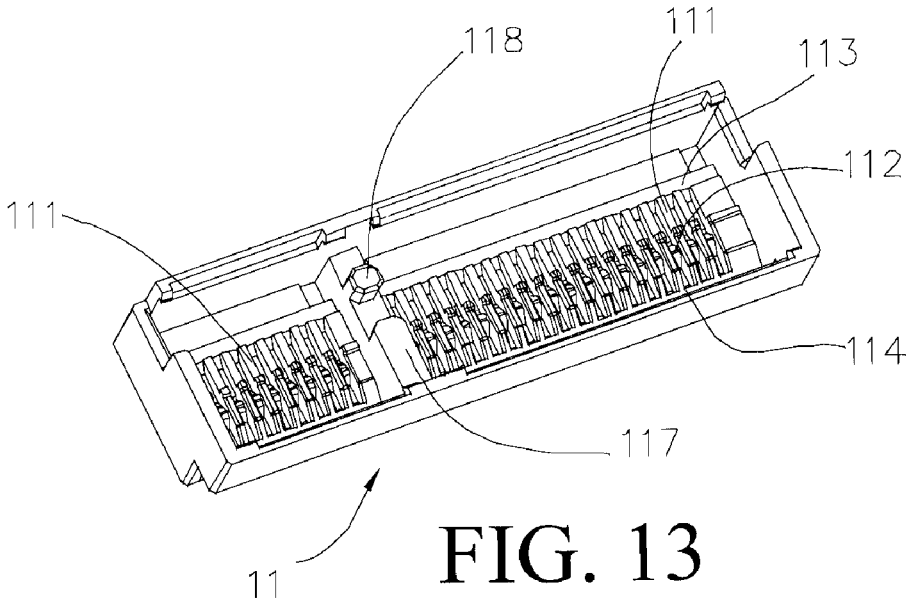
FIG. 13 is a three-dimensional diagram of FIG. 12 in another direction.
Figure 14:
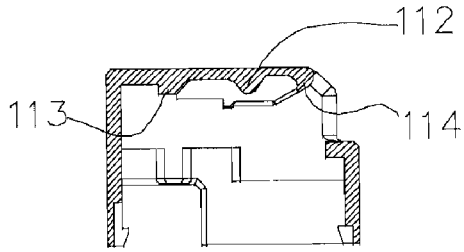
FIG. 14 is a cross-section diagram of FIG. 12.

Please refer to FIG. 11, a holding block 1001 is located at the extension of the base portion 100 of the insulating base. The holding portion 1002 is located at the holding block 1001, and the surface at the holding block 1001 relative to the first terminal (its extended line is the dotted line G) is tilted from the inserting direction of an external electrical device (e.g., an electrical card, not shown in the figure). It is assumed that the direction shown in FIG. 11 is the inserting direction of an external electrical device. There will be an included angle between the directions G and A. That is to say, the surface at the holding block 1001 relative to the terminal is tilted from the inserting direction of an external electrical device.

The connecting arm 12121 is formed by a tilt extending from the first body portion 1211 toward the direction of the holding portion 1002. The connecting arm 12121 (its extended line is the dotted line H) is tilted from the inserting direction of an external electrical device. There will be also an included angle between the directions H and A. Thus, the connecting arm 12121 is tilted from the inserting direction of an external electrical device. The tilting angle e between the surface at the holding block 1001 relative to the terminal and the inserting direction of an external electrical device is smaller than the tilting angle f between the connecting arm and the inserting direction of an external electrical device. Thus, the connecting arm 12121 can be naturally and elastically pressed on the holding portion 1002 of the holding block 1001.

At this time, the holding point that the connecting arm is pressed on the holding portion 1002 is between the connecting portion 12122 and the first body portion 1211. When the connecting arm contacts with the entire holding block 1001, it can be avoid that the effect of the roughness of the holding block 1001 on the surface of the connecting portion 12122 of the connecting arm 12121 to affect the performance of the electrical connector.

Of course, the direction A is not the only option for the inserting direction of the external electrical device. It can be any direction within the range of the included angle formed by the contacting points where the contacting portions of the first terminal and the second terminal contact with the external electrical device. For example, the inserting direction of the external electrical device can be the direction B shown in the figure. The tilting angle between the surface at the holding block 1001 relative to the terminal and the inserting direction of an external electrical device is still smaller than the tilting angle between the connecting arm and the inserting direction of an external electrical device.

Figure 17:
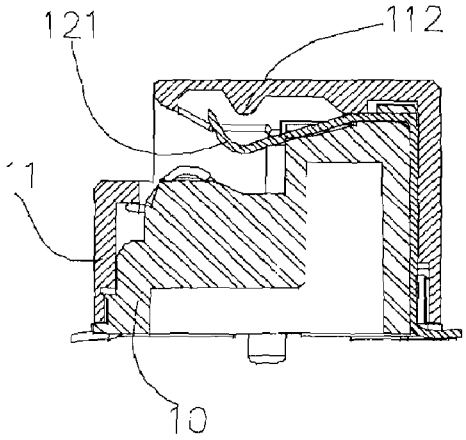
FIG. 17 is a cross-section diagram of FIG. 15 in the direction of b-b.

Please refer to FIGS. 12~16, the electrical connector further includes a housing 11 cooperating with the insulating base 10. The fence on the insulating base 10 is a first fence 106. A plurality of second fence 111 corresponding to the first fence 106 on the insulating base 10 are on the inner surface of the housing 11. At the same time, an enhancing rib 112, between the second fences 111 on the housing 11, is used for enhancing the surface strength of the housing 11. The shape of the enhancing rib 112 corresponds to that of the first contacting portion of the first terminal 121. And, the top of the extruding part of the enhancing rib 112 is lower than the peak of the corresponding first terminal 121 (as shown in FIG. 17).

The ribs 113, 114 interlaced with the enhancing rib 112 are located at two sides of the second fence 111 on the inner surface of the housing 11. The enhancing rib 112 and the ribs 113, 114 can effectively enhance the strength of the housing 11 to avoid deforming and breaking the housing during fabrication because the housing is too thin. And, an opening 116 is located at a side surface of the housing 11. After fabrication, the housing 11 and the insulating base 10 can conjointly form an interface 20 for inserting a connecting electrical card (not shown in the figure). After inserting, the electrical card is connected to the terminal covered by the housing 11 to reach the electrical connection between the electrical card and the electrical connector.

An extruding block 117 is located at one side of the housing 11 and extends downward to the side surface with the opening 116 from the inner surface of the housing 11 to form a fool-proof device. After the housing 11 is fabricated to the insulating base 10, the extruding block 117 is accepted in the accepting tank 1031 of the insulating base 10. And, the extruding block 117 can also cooperate with the fool-proof tank (not shown in the Figure) to prevent the user inserting the wrong electrical card. A cylinder 118 which downward extends from the extruding block 117 is located at the extruding block 117.

Figure 18:
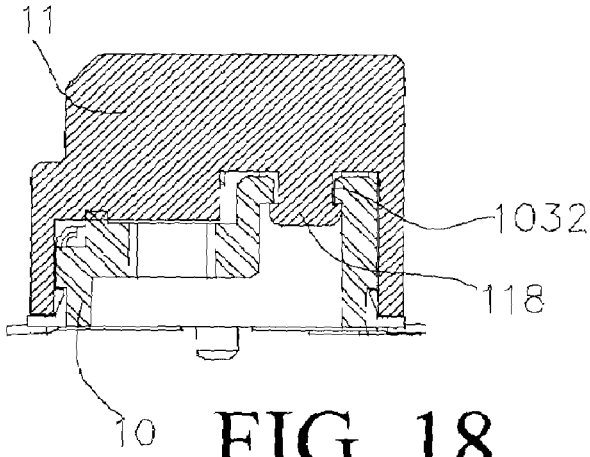
FIG. 18 is a cross-section diagram of FIG. 16 in the direction of d-d.

The cylinder 118 can be inserted into the trough 1032 on the accepting tank 1031 of the insulating base 10. Then, the cylinder 118 is melted. At this time, the size of the end of the cylinder 118 passing through the trough 1032 is larger than that of the top of the trough 1032 (as shown in FIG. 16 and FIG. 18). Thus, the housing 11 and the insulating base 10 are integrated into a unity to prevent the housing 11 out of the insulating base 10 during using to affect the normal use of the electrical connector.

Figure 19:
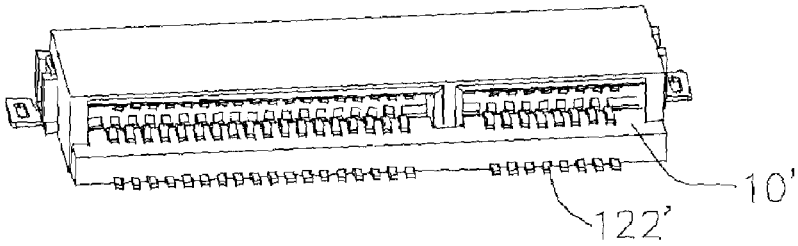
FIG. 19 is a three-dimensional diagram of the electrical connector in the second embodiment based on the invention.
Figure 20:
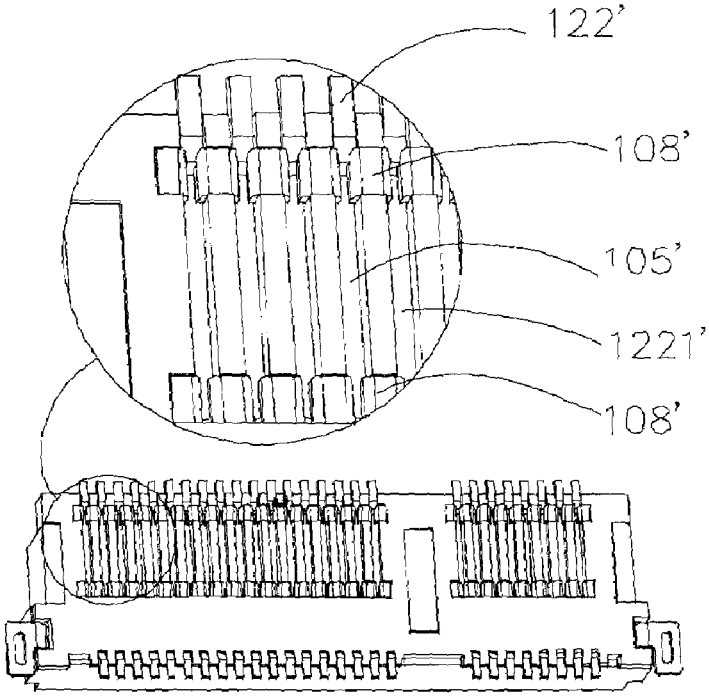
FIG. 20 is a three-dimensional diagram of FIG. 19 in another direction.
Figure 21:
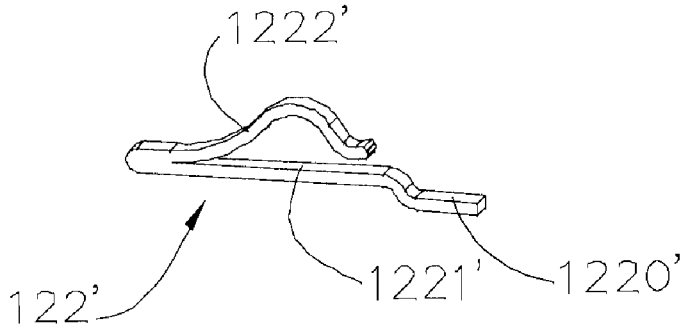
FIG. 21 is a three-dimensional diagram of the terminal of the electrical connector shown in FIG. 19.
Figure 22:
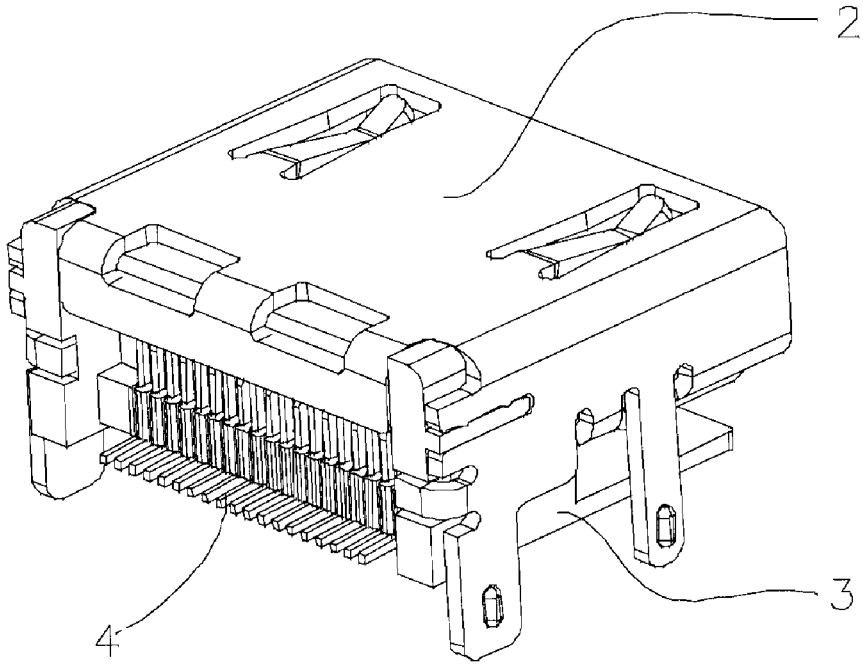
FIG. 22 is a three-dimensional diagram of the electrical connector in the third embodiment based on the invention.
Figure 23:
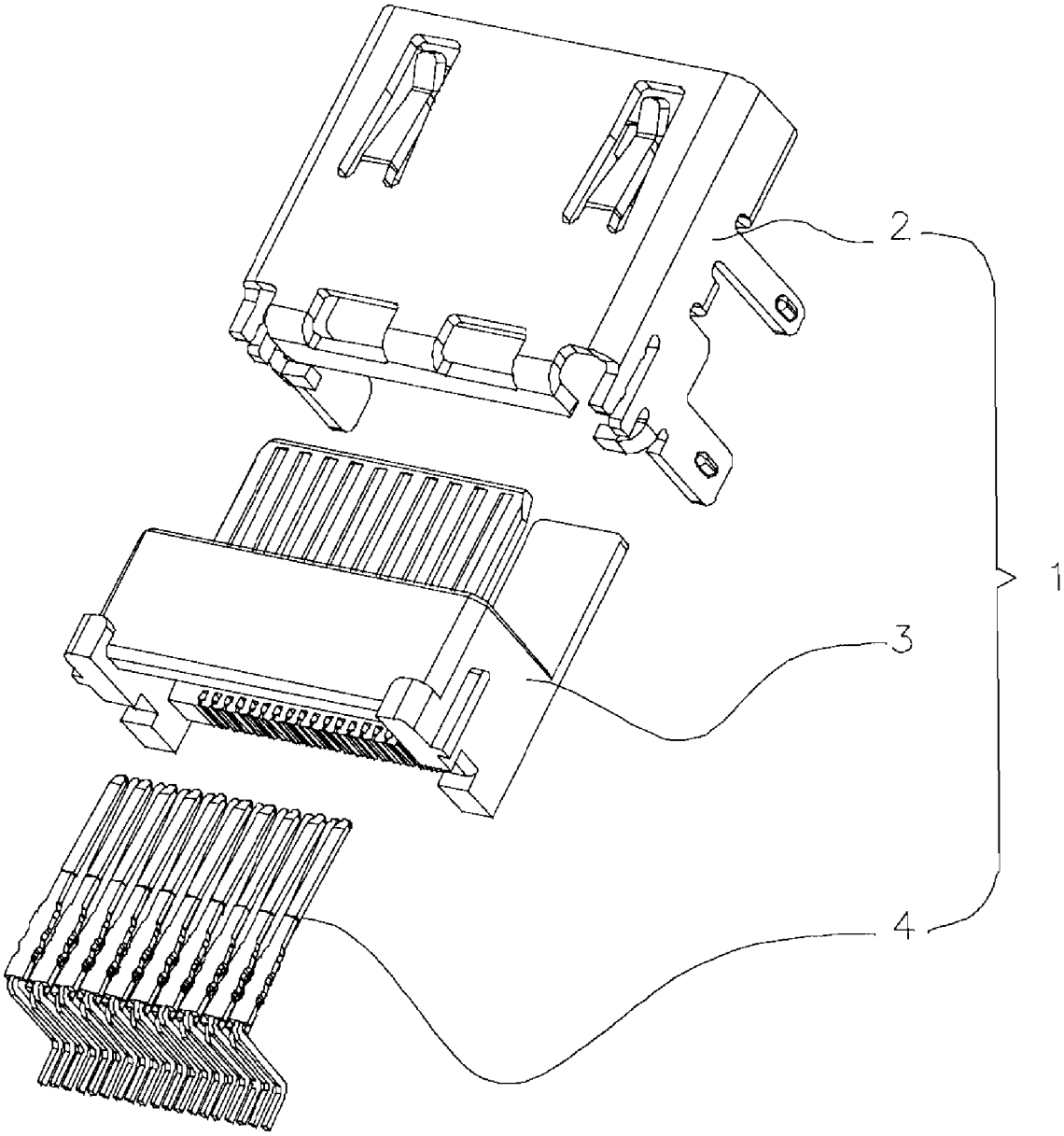
FIG. 23 is a three-dimensional decomposed diagram of FIG. 22.

Please refer to FIGS. 19~21, FIGS. 19~21 are diagrams of the electrical connector in the second embodiment based on the invention. Compared to the above embodiments, the difference is that the total height of the electrical connector is smaller in the embodiment. The second terminal 122' at the electrical connector is not set on the front end surface of the insulating base 10'. The second terminal accepting tank 105' at the electrical connector passes through the bottom surface o the insulating base. The second terminal 122' is set in the insulating base from the bottom of the insulating base 10'.

And, the fixing structure 108' for fixing the terminal is formed by extending the fences between the second terminal accepting tanks 105'. The second terminal 122' also includes a second connecting portion 1220', a second body portion 1221' extending from the second connecting portion 1220', and a second contacting portion 1222' extending from the second body portion 1221'. The second terminal 122' is set in the second terminal accepting tank 105'. The second body portion 1221' is set in the second terminal accepting tank of the bottom surface. The fixing structure 108' is set at the area of the second body portion 1221' near the second connecting portion 1220' and the area of the second body portion 1221' near the second contacting portion 1222'.

Please refer to FIGS. 22~29, FIGS. 22~29 are diagrams of the electrical connector in the third embodiment based on the invention. The electrical connector 1 includes a metal housing 2, an insulating base 3, and a plurality of terminals 4. The metal housing 2 covers the corresponding insulating base 3.

Figure 24:
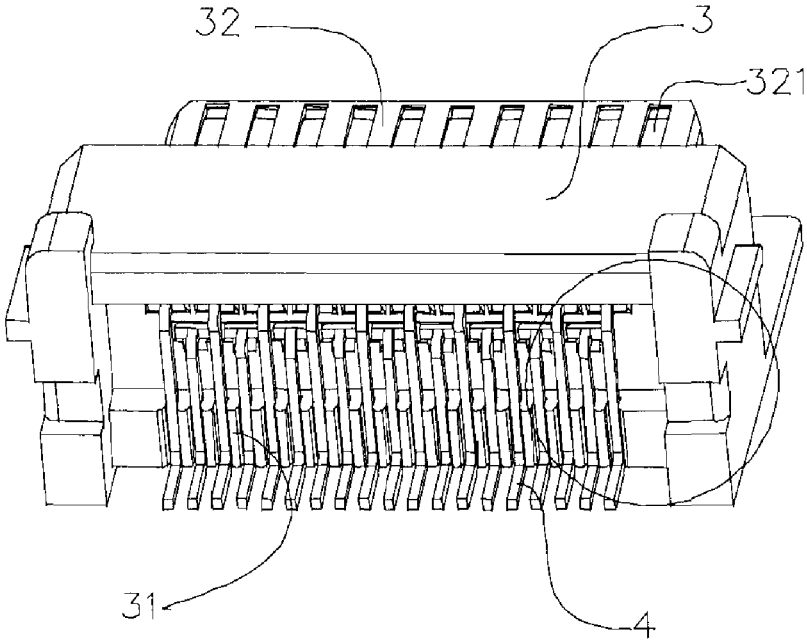
FIG. 24 is a diagram of the protruding portion of the electrical connector in the third embodiment based on the invention when the protruding portion is not forced by an external force.
Figure 25:
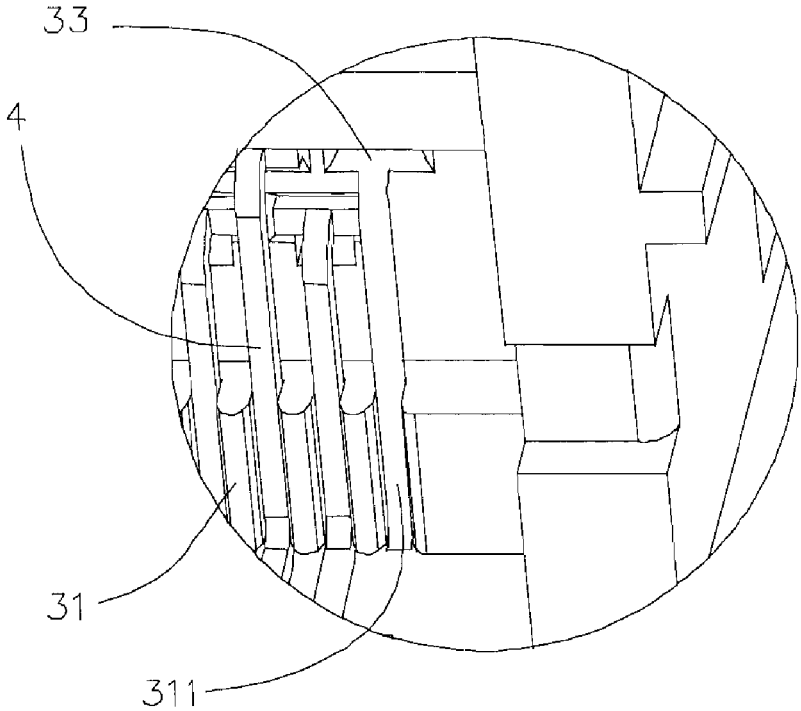
FIG. 25 is a partial enlarged diagram of FIG. 24.
Figure 26:
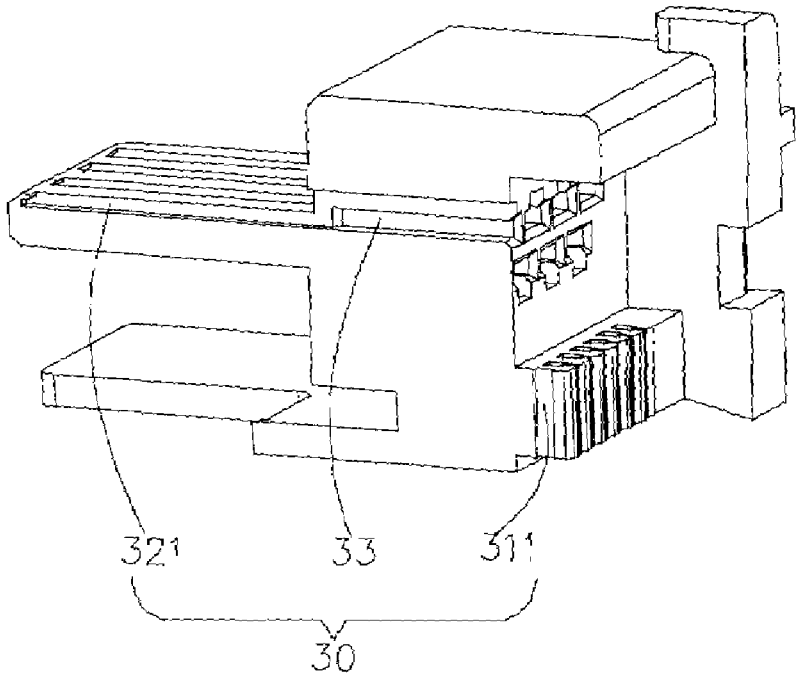
FIG. 26 is a cross-section diagram of the insulating base of the electrical connector in the third embodiment based on the invention.

The corresponding insulating base 3 includes an extruding portion 31 located at the terminal. The height of the extruding portion 31 is higher than that of the terminal 4. Please refer to FIGS. 24~26, FIGS. 24~26 are diagrams of the extruding portion 31 of the electrical connector 1 based on the invention before the extruding portion 31 is forced by an external force. The insulating base 3 includes a tongue board 32. The extruding portion 31 is set at one end of the insulating base 3 away from the tongue board 32. The insulating base 3 also includes a plurality of the terminal accepting hole 30. The terminal accepting hole 30 is formed by the tank 321, the accepting space 311 between the extruding portion 31, and the through hole 33 between the tongue board 32 and the extruding portion 31.

Figure 27:
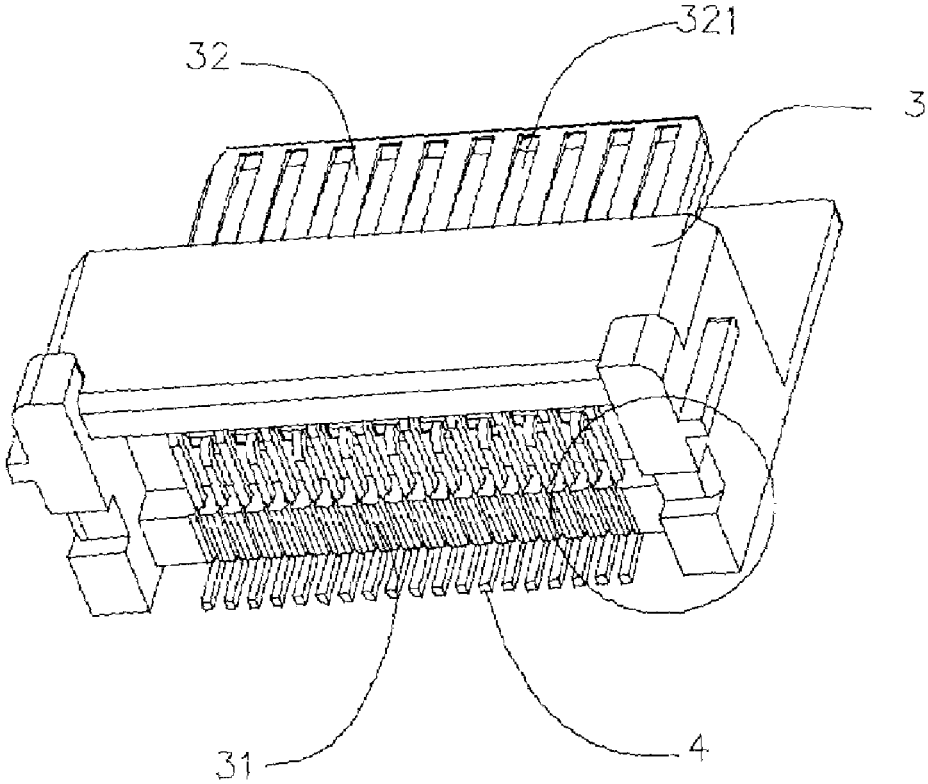
FIG. 27 is a diagram of the protruding portion of the electrical connector in the third embodiment based on the invention after the protruding portion is forced by an external force.
Figure 28:
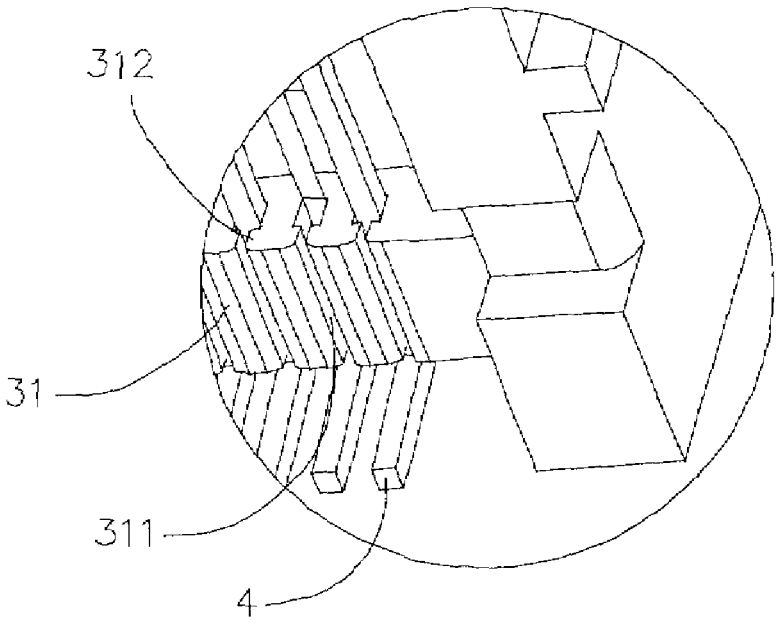
FIG. 28 is a partial enlarged diagram of FIG. 27.

Please refer to FIGS. 27~28, FIGS. 27~28 are diagrams of the extruding portion 31 of the electrical connector 1 based on the invention after the extruding portion 31 is forced by an external force. The wedging portion 312 can be formed from the extruding portion 31 of the insulating base 3 by a melting method. First, the end of the extruding portion 31 is softened by heating or supersonic scanning. Afterward, the end is compressed by adding an external force to form the wedging portion 312. Of course, the wedging portion 312 can also be formed through stamping or other modes.

Figure 29:
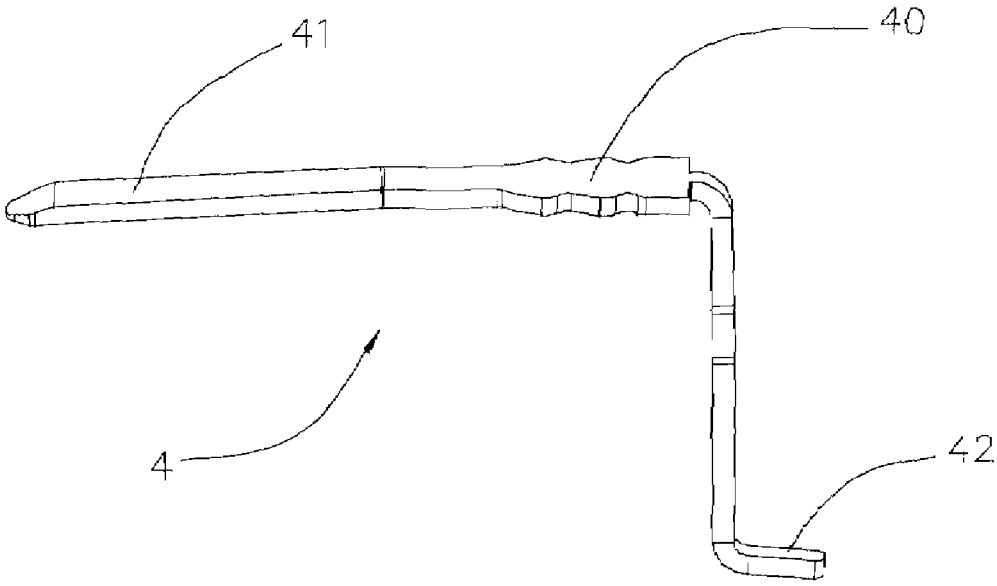
FIG. 29 is a diagram of the terminal of the electrical connector in the third embodiment based on the invention.

Referring to FIG. 29, the terminal 4 includes a contacting portion 41, a welding portion 42, and a connecting portion 40 connecting the contacting portion 41 and the welding portion 42. The contacting portion 41' is in the tank 321 on the tongue board 32 of the terminal accepting hole 30. The connecting portion 40 passes through the through hole 33 on the insulating base and partially in the accepting space 311 between the extruding portions 31. The connecting portion 40 is bended to be a right angle. The welding portion 42 is formed by bending and extending one end of the connecting portion 40. The welding portion 42 can be welded on a circuit board or other electrical devices (not shown in the figures).

The terminal 4 can be first pressed into the insulating base 3 during fabrication. At this time, the connecting portion 40 passes through the through hole 33 on the insulating base and partially in the accepting space 311 between the extruding portions 31. The contacting portion 41 is in the tank 321 on the tongue board 32 of the terminal accepting hole 30. Then, the end of the extruding portion 31 is softened by heating or supersonic scanning. Afterward, the end is compressed by adding an external force to form the fixing portion 312. Of course, the fixing portion 312 can also be formed through stamping or other modes.

The extruding portion 31 of the electrical connector based on the invention can also be set as two or more rows and reach the same effect. Thus, the above mentioned electrical connector is also in the protecting scope of the invention.

Figure 30:
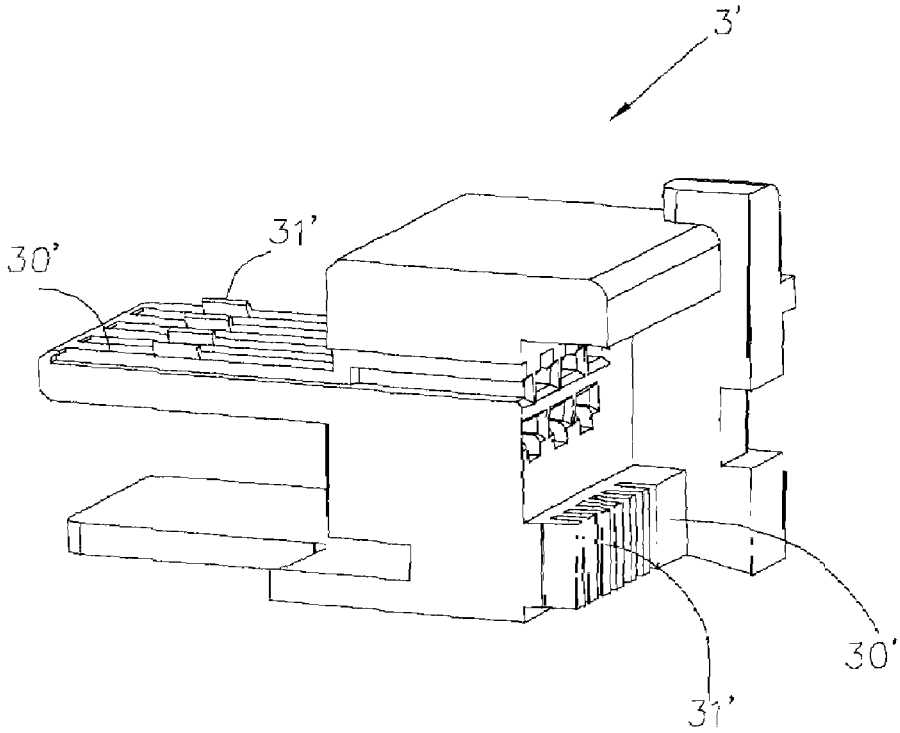
FIG. 30 is a partial diagram of the insulating base of the electrical connector in the fourth embodiment based on the invention.
Figure 31:
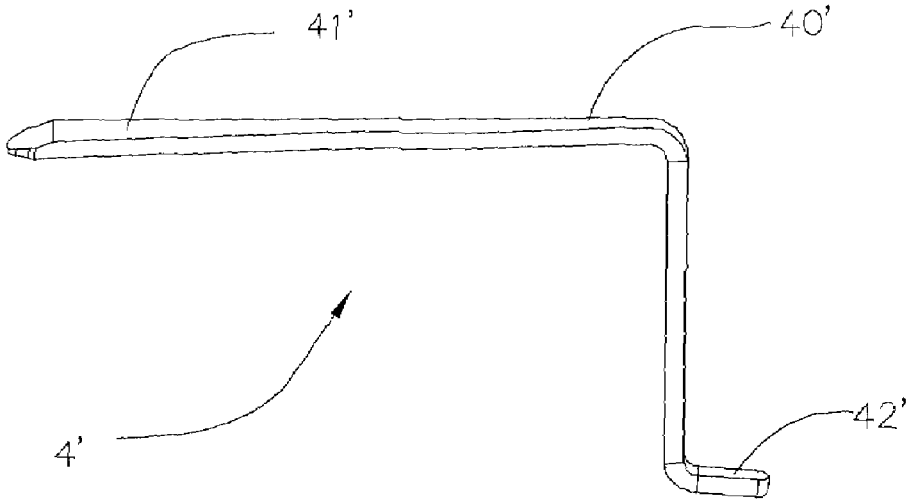
FIG. 31 is a diagram of the terminal of the electrical connector in the fourth embodiment based on the invention.

FIG. 30 is a partial diagram of the insulating base of the electrical connector in the fourth embodiment based on the invention. Compared to the third embodiment based on the invention, the difference is that the insulating base 3' includes two assembling surfaces 30' for assembling the terminal, and both two assembling surfaces 30' include the extruding portion 31' for positioning the terminal. Please refer to FIG. 31, the terminal 4' includes a contacting portion 41' and a welding portion 42' welding with a circuit board or other electrical devices (not shown in the figures). A connecting portion 40' is located at the area between the contacting portion 41' and the welding portion 42'. The connecting portion 40' is bended to be a right angle. The extruding portion 31' can be formed as a wedging portion for fixing the conducting terminal 4' through a deformation by an external force (it is not shown in this embodiment because its theory is the same with the first embodiment). During the practicing process, the effect achieved in the above embodiments can also be reached in this embodiment.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An electrical connector comprising:

an insulating base including a plurality of terminal accepting channels; and a plurality of terminals correspondingly received in the terminal accepting channels;

wherein the insulating base is further formed with a plurality of fixing structures located at the terminal accepting channel for fixing the terminals via a melting-glue method, the terminal accepting channel is located at the back end surface and top surface of the insulating base, the terminal comprises a connecting portion, a body portion extending from the connecting portion, and a flexible arm extending from the body portion, the body portion is disposed in the terminal accepting channel located at the back end surface, the flexible arm is disposed in the terminal accepting channel located at the top surface, the fixing structure is located at the area where the body portion is near to the connecting portion and the area where the connecting portion is near to the body portion.

2. The electrical connector as claimed in claim 1, wherein the fixing structure is located at an area where the body portion is near to the connecting portion.

3. The electrical connector as claimed in claim 1, wherein the fixing structure is located at two ends of the body portion.

4. The electrical connector as claimed in claim 1, wherein the terminal has a concave portion disposed in the fixing structure, and the fixing structure has a correspondingly wedging portion set in the concave portion.

5. The electrical connector as claimed in claim 4, wherein a first concave portion and a second concave portion are respectively located at two sides of the terminal, and the first concave portion and the second concave portion are interlaced with each other.

6. The electrical connector as claimed in claim 1, wherein the fixing structure comprises a fixing block above the terminal and extending in a transversal direction defined by the terminal, and the end of the fixing block is not over the center of the terminal.

7. The electrical connector as claimed in claim 1, wherein the cross-section of the fixing structure is a rectangle, a triangle, or a fan shape.

8. The electrical connector as claimed in claim 1, wherein the electrical connector further comprises a shell, and an interface is formed by the insulating shell and the insulating base.

9. The electrical connector as claimed in claim 1, wherein a through hole is disposed on the insulating body, a cylinder passing through the through hole extends from the shell, and the size of the head portion of the cylinder is larger than that of the through hole.

10. The electrical connector as claimed in claim 1, wherein terminal accepting channel for accepting a second terminal is located at the front end surface of the insulating base, the second terminal comprises a second connecting portion, a second body portion extending from the second connecting portion, and a second flexible arm extending from the second body portion, the second body portion is disposed in the second terminal accepting channel located at the front end surface, the fixing structure is disposed on the area where the second body portion is near to the second connecting portion and the area where the second flexible arm is near to the second body portion.

11. The electrical connector as claimed in claim 1, wherein a second terminal accepting channel for accepting a second terminal is located at the bottom surface of the insulating base, the second terminal comprises a second connecting portion, a second body portion extending from the second connecting portion, and a second flexible arm extending from the second body portion, the second body portion is disposed in the second terminal accepting channel located at the bottom surface, the fixing structure is disposed on the area where the second body portion is near to the second connecting portion and the area where the second body portion is near to the second flexible arm.

12. An electrical connector comprising:

an insulating base including a plurality of fences and terminal accepting channels formed between the two adjacent fences; and a plurality of terminals correspondingly received in the terminal accepting channels;

wherein the insulating base is further formed with a plurality of fixing structures located on ends of the fences and extending toward the terminals, the terminal accepting channel is located at the back end surface and top surface of the insulating base, the terminal comprises a connecting portion, a body portion extending from the connecting portion, and a flexible arm extending from the body portion, the body portion is disposed in the terminal accepting channel located at the back end surface, the flexible arm is disposed in the terminal accepting channel located at the top surface, the fixing structure is located at the area where the body portion is near to the connecting portion and the area where the connecting portion is near to the body portion.

13. The electrical connector as claimed in claim 12, wherein the terminal has a concave portion disposed in the fixing structure, and the fixing structure has a correspondingly wedging portion set in the concave portion.

14. The electrical connector as claimed in claim 12, wherein the fixing structure comprises a fixing block above the terminal and extending in a transversal direction defined by the terminal, and the end of the fixing block is not over the center of the terminal.

15. The electrical connector as claimed in claim 12, wherein a through hole is disposed on the insulating body, a cylinder passing through the through hole extends from the shell, and the size of the head portion of the cylinder is larger than that of the through hole.

* * * * *